US006719651B1

(12) United States Patent
Newey

(10) Patent No.: US 6,719,651 B1
(45) Date of Patent: Apr. 13, 2004

(54) TENNIS BALL RETRIEVAL DEVICE

(76) Inventor: James A. Newey, 56 Locksly La., San Rafael, CA (US) 94901

( * ) Notice: Subject to any disclaimer, the term of this patent is extended or adjusted under 35 U.S.C. 154(b) by 0 days.

(21) Appl. No.: 10/405,465

(22) Filed: Apr. 2, 2003

(51) Int. Cl.[7] ..... A63B 47/02; A63B 61/00
(52) U.S. Cl. ..... 473/553; 423/517
(58) Field of Search ..... 473/553, 524, 473/517, 286; 294/19.2

(56) References Cited

U.S. PATENT DOCUMENTS

| | | | | | |
|---|---|---|---|---|---|
| 2,044,838 | A | * | 6/1936 | Douglas | 294/19.2 |
| 2,802,687 | A | * | 8/1957 | DuChene | 294/19.2 |
| 2,968,509 | A | * | 1/1961 | Borah | 294/19.2 |
| 3,874,666 | A | | 4/1975 | Ross | |
| 4,114,881 | A | * | 9/1978 | Norton | 473/517 |
| 4,210,327 | A | | 7/1980 | Schubert | |
| 4,979,742 | A | * | 12/1990 | DiFranco | 473/415 |
| 4,993,712 | A | * | 2/1991 | Urwin | 473/517 |
| 5,056,786 | A | | 10/1991 | Bellettini et al. | |
| 5,299,846 | A | * | 4/1994 | Rush | 294/19.2 |
| 5,333,854 | A | | 8/1994 | Woollard et al. | |
| 5,437,488 | A | * | 8/1995 | Richmond et al. | 294/19.2 |
| 6,638,177 | B1 | * | 10/2003 | Wang | 473/286 |
| 2002/0169030 | A1 | * | 11/2002 | Chun-Sheng | 473/286 |

FOREIGN PATENT DOCUMENTS

| | | | | |
|---|---|---|---|---|
| FR | 2775908 | * | 9/1999 | A63D/5/02 |
| GB | 2128484 | * | 5/1984 | A63B/53/14 |

* cited by examiner

*Primary Examiner*—Raleigh W. Chiu
(74) *Attorney, Agent, or Firm*—Sturm & Fix LLP

(57) ABSTRACT

A gripping device (10) for attachment to the bottom (102) of a tennis racquet (100) to retrieve tennis balls (200) wherein, the gripping device (10) is fabricated from a used tennis ball (20) having at least its lower quadrant severed beneath the midline of the used tennis ball (20) wherein, a plurality of vertically extending slits (22) are initiated at the sever line (24) to a point above the midline of the used tennis ball (20) to create gripping fingers (25) that will releasably engage the periphery of relatively new tennis balls (200).

10 Claims, 1 Drawing Sheet

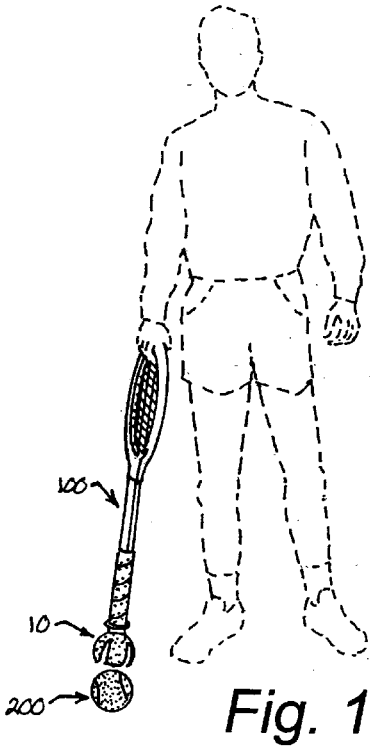
Fig. 1
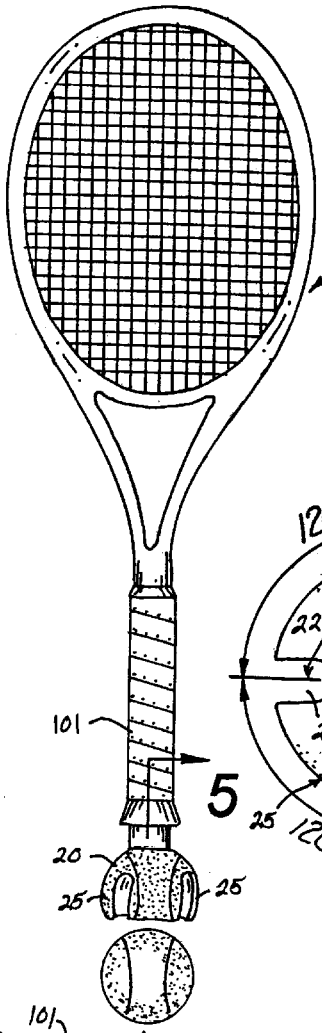
Fig. 2
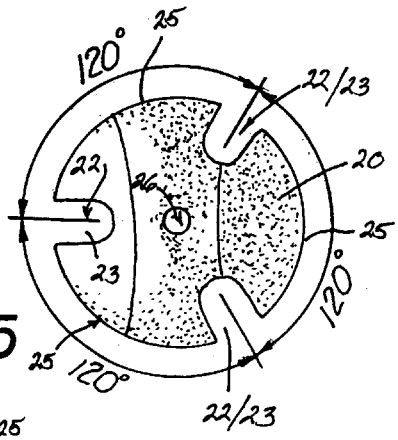
Fig. 4
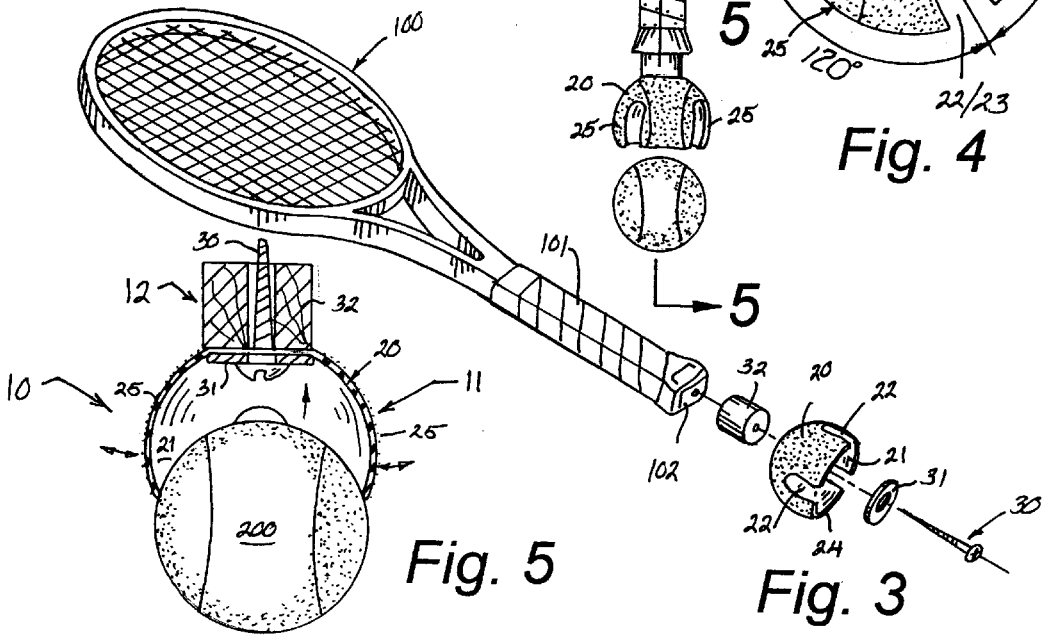
Fig. 5
Fig. 3

TENNIS BALL RETRIEVAL DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of ball retrieval apparatus in general and in particular to a tennis ball retrieval device that recycles used tennis balls.

2. Description of Related Art

As can be seen by reference to the following U.S. Pat. Nos. 5,056,786; 4,210,327; 5,33,854; and, 3,874,666, the prior art is replete with myriad and diverse tennis ball retrieval arrangements.

While all of the aforementioned prior art constructions are more than adequate for the basic purpose and function for which they have been specifically designed, they are uniformly deficient with respect to their failure to provide a simple, efficient, and practical tennis ball retrieval device that employs a used tennis ball to retrieve new tennis balls.

With all of the prior art arrangements, newly fabricated materials are employed to form a releasably capturing arrangement to retrieve a new tennis ball having a relatively pristine fuzzy surface which totally ignores the fact that while the normal useful life span of a tennis ball is relatively short for its original purpose, it can provide a prolonged useful life in another reincarnation.

As a consequence of the foregoing situation, there has existed a longstanding need among environmentally responsible tennis players for a new and improved tennis ball retrieval device that employs a recycled tennis ball as the primary component of the retrieval device and the provision of such a construction is a stated objective of the present invention.

BRIEF SUMMARY OF THE INVENTION

Briefly stated, the tennis ball retrieval device that forms the basis of the present invention comprises in general a ball retrieval unit and a mounting unit that is adapted to secure the ball retrieval unit to the bottom of the handle of a tennis racquet.

As will be explained in greater detail further on in the specification, the ball retrieval unit comprises in general a used tennis ball having its lower segment removed to form a receptacle wherein, a plurality of openings is created in the remainder of the unsevered portion of the tennis ball extending upwardly from the sever line to create a plurality of flexible gripping fingers or flaps that will expand to frictionally engage the periphery of another tennis ball.

In this manner, the retrieval device of this invention is not only environmentally responsible by using recycled tennis balls, but also produces an aesthetically pleasing appearance when affixed to a tennis racquet.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view showing the tennis ball retrieval device of this invention in use;

FIG. 2 is a perspective view of a tennis racquet equipped with the retrieval device and a tennis ball;

FIG. 3 is an exploded perspective view of the tennis racquet, the retrieval unit, and the mounting unit;

FIG. 4 is a top plan view of the retrieval unit; and,

FIG. 5 is a cross-sectional view taken through line 5—5 of FIG. 2.

DETAILED DESCRIPTION OF THE INVENTION

As can be seen by reference to the drawings, and in particularly to FIG. 5, the tennis ball retrieval device that forms the basis of the present invention is designated generally by the reference number 10. The retrieval device 10 comprises in general a ball retrieval unit 11 and a mounting unit 12. The units will now be described in seriatim fashion.

As can best be appreciated by reference to FIGS. 2 through 5, the ball retrieval unit 11 comprises a used tennis ball 20 that has been severed transversely below its mid-line to at least remove the tower quadrant of the used tennis ball 20 and expose the interior surface 21 of the used tennis ball 20.

Turning now to FIGS. 3 and 4, it can be seen that the main portion of the severed tennis ball 20 is further provided with a plurality of slits 22 that extends upwardly from the sever line that is designated generally as 24 wherein, in the preferred embodiment of the invention, the slits 22 are actually arcuate slots 23 that extend upwardly from the circular periphery of the sever lines at intervals of 120° to form a plurality of flexible gripping fingers 25.

At this juncture, it should be noted that the slits 22 extend above the midline of the original used tennis ball 20 to allow the gripping fingers 25 to expand beyond the original diameter of the used tennis ball 20 to securely grasp the periphery of a new tennis ball 200.

Furthermore, the slits 22 are given an arcuate slot configuration to prevent the slits 22 from expanding in length after repeated flexure of the gripping fingers 25, and the main portion of the severed tennis ball 20 is further provided with a central aperture the purpose and function of which will be explained presently.

As shown in FIGS. 3 and 5, the securing unit 12 primarily comprises a conventional threaded fastener 30 having a shaft that is adapted to pass through the central opening 26 in the used tennis ball 20 and threadedly engage the bottom 102 of the handle portion 101 of a tennis racquet.

In addition, the securing unit 12 may further include a washer element 31 disposed on the interior 21 of the tennis ball 20 and resilient or rigid collar element disposed intermediate the tennis ball 20 and the bottom 102 of the tennis racquet 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A gripping device for installation on the bottom of the handle portion of a tennis racquet to retrieve a tennis ball wherein, the gripping device comprises a retrieval unit including a used tennis ball having at least its lower quadrant severed below the midline of the used tennis ball to expose the interior of the tennis ball, and provided with a plurality of vertical slits extending upwardly from the lower periphery of the main portion of the severed tennis ball to define a plurality of gripping fingers; and, means for securing the central portion of the severed tennis ball to the bottom of the handle of a tennis racquet.

2. The gripping device as in claim 1 wherein, said vertical slits define arcuate slots.

3. The gripping device as in claim 1; wherein, said means for securing the severed tennis ball to the tennis racquet includes at least a threaded fastener.

4. The gripping device as in claim 3; wherein, said means further comprises a washer disposed intermediate the interior of the severed tennis ball and the threaded fastener.

5. The device as in claim 4; wherein, said means further comprises a collar element disposed on both the exterior surface of the severed tennis ball and in a surrounding fashion relative to a portion of the threaded fastener.

6. The device as in claim 2; wherein, said means for securing the severed tennis ball to the tennis racquet includes at least a threaded fastener.

7. The device as in claim 6; wherein, said means further comprises a washer disposed intermediate the interior of the severed tennis ball and the threaded fastener.

8. The device as in claim 7; wherein, said means further comprises a collar element disposed on both the exterior surface of the severed tennis ball and in a surrounding fashion relative to a portion of the threaded fastener.

9. A method of recycling used tennis balls for further use as a ball retrieval device that is mounted on the bottom of the handle of a tennis racquet including the steps of a) severing at least the lower quadrant of a used tennis ball below the midline of the used tennis ball b) forming a plurality of vertically extending slits from the severed periphery of the main portion of the used tennis ball to a point above the original midline of the used tennis ball; and, c) securing the center of the main portion of the used tennis ball to the bottom of the handle of the tennis racquet.

10. The method as in claim 9 further comprising the intermediate step of:

d) creating a curved terminal end on each of the plurality of vertical slits.

* * * * *